US005169555A

United States Patent [19]

Mikulski et al.

[11] Patent Number: 5,169,555

[45] Date of Patent: Dec. 8, 1992

[54] PULP BLEACHING SOLUTION

[75] Inventors: Richard A. Mikulski, Salem; Michael M. Cook, Boxford, both of Mass.

[73] Assignee: Morton International, Inc., Chicago, Ill.

[21] Appl. No.: 612,033

[22] Filed: Nov. 9, 1990

[51] Int. Cl.[5] ..... C01B 6/10

[52] U.S. Cl. ..... 252/188.26; 252/188.22; 252/188.23; 162/83; 162/80

[58] Field of Search ..... 252/188.23, 188.24, 252/188.26

[56] References Cited

U.S. PATENT DOCUMENTS

| | | | |
|---|---|---|---|
| 2,970,114 | 1/1961 | Bragdon | 252/188 |
| 3,538,012 | 11/1970 | Goerrig | 252/188 |
| 3,819,807 | 6/1974 | Schreiner et al. | 423/265 |
| 3,933,676 | 1/1976 | Wade | 252/188 |
| 3,933,677 | 1/1976 | Wade | 252/188 |
| 4,115,293 | 9/1978 | Schoenholz et al. | 252/188 |
| 4,160,693 | 7/1979 | Lindahl et al. | 162/25 |
| 4,283,303 | 8/1981 | Ellis | 252/188 |
| 4,610,728 | 9/1986 | Natesh et al. | 134/2 |

OTHER PUBLICATIONS

Chemical Abstracts, vol. 80, 1974, 49509p.

*Primary Examiner*—Richard D. Lovering
*Assistant Examiner*—Joseph D. Anthony
*Attorney, Agent, or Firm*—Wayne E. Nacker; Gerald K. White

[57] ABSTRACT

A sodium borohydride/sodium hydroxide solution for dithionite generation contains sufficient levels of diethylene triamine pentaacetic acid to chelate metals in the dithionate generation process and also in a pulp bleaching process.

2 Claims, No Drawings

PULP BLEACHING SOLUTION

The present invention is directed to solutions for bleaching pulp and more particularly to a solution of sodium borohydride, sodium hydroxide and a chelating agent.

BACKGROUND OF THE INVENTION

Wood pulp to be used in paper is commonly bleached in order that the final paper products achieve a desired degree of brightness. As described by P. Joyce and David M. Mackie in "Brightening of Mechanical Pulps", MacMillan Bloedel Reasearch, Vancouver, B.C., Canada, bleaching may either be reductive, oxidative or a combination of oxidative followed by reductive (but not reductive followed by oxidative). The choice of a bleaching method depends upon the degree of brightening required and the costs of the bleaching system. Oxidative bleaching can achieve a greater increase in brightening points than reductive bleaching, but is considerably more expensive than reductive bleaching. Maximum brightening is achieved with oxidative/reductive bleaching, but with further increased costs.

The present invention pertains to solutions for reductive pulp bleaching, which among the bleaching processes mentioned above provides the least amount of brightening, but is nevertheless the least expensive and has widespread application where maximum brightness of pulp is not required, e.g., in preparing pulp for making newsprint.

The commonly used bleaching agent for reductive bleaching is sodium dithionite (sodium hydrosulfite), the dithionite ion ($S_2O_4^=$), thereby provided, being the active bleaching species. Dithionite is typically provided to pulp in one of three manners: A) a sodium dithionite-based product in dry form may be dissolved and added to a pulp slurry, B) from commercial sodium dithionite solution products which have limited storage stabilities, or C) dithionite may be generated on-site from sodium borohydride, sodium hydroxide and an available $S^{4+}$ species, such as $SO_2$, waste $HSO_3^-$, or $HSO_3^-/SO_2$ solution (raw acid). The chemistry and cycle of an on-site dithionite generation is described, for example, in "Hydrosulfite Bleaching" by R. Barton, C. Tredway, M. Elles and E. Sulivan, *Pulp and Paper Manufacture, 3rd Edition, Volume* 2, Mechanical Pulping, R. A. Leask (Ed.) Tappi/CPPA Joint Textbook Committee of the Paper Industry (1987).

In order that the present invention may be fully appreciated, the invention should be understood in its economic context. On-site generation of dithionite C) has been proven to be more cost efficient than A) or B), addition of dithionite-based products. However, while there are cost efficiencies of on-site generation relative to addition of anhydrous sodium dithionite-based products, the cost advantage is not so great that the relative cost efficiencies cannot be lost through cost penalties that may result from increased costs of materials, shipping, etc. Furthermore, the cost benefits of on-site generation must be sufficiently attractive to pay for the capital costs for the dithionite generation apparatus.

Generally, all of the bleaching processes, reductive, oxidative and oxidative/reductive, are enhanced through the use of chelants or sequesterants that effectively inactivate metal ions. Metal ions tend to produce color in the paper product, iron ions being the most detrimental to achieving brightness. Reductive bleaching typically adds 6–10 brightness points to pulp (more commonly 7–8 brightness points), and appropriate use of a chelant will typically add another 1–2 brightness points. Furthermore, a chelant will minimize brightness reversion that results during paper production by oxidation of previously reduced chemical species.

In current reductive bleaching processes in which dithionite is generated on-site, a chelant-containing solution is added to the pulp in a separate stream, either prior to or concurrent with addition of the dithionite bleaching agent. (In fact, most commercial sodium dithionite-based products contain a chelating or sequestering agent.) It is a primary goal of the present invention to provide a solution for generating dithionite on-site which provides both dithionite and a sufficient level of chelating agent to pulp in the same stream.

It can be appreciated that directing a single stream to a process, i.e., pulp bleaching, is advantageous relative to directing and controlling two streams. However, there is an important additional reason for wishing to include a chelating agent in a solution used for dithionite generation. The $S^{4+}$ source, e.g., waste $HSO_3^-$, used in dithionite generation, may frequently contain undesireable metal ions. In the dithionite generation process, divalent calcium and magnesium ions can precipitate as scale that builds upon sensors and/or clog rotometers to render them ineffective. Iron ions tend to precipitate as insoluble black particles, which are clearly undesirable in a bleaching solution that is provided to enhance brightness.

Developing a solution for the on-site generation of dithionite and also containing a chelating agent proved not to be a straight-forward task, particularly bearing in mind that substantial cost penalties could not be incurred without making on-site dithionite generation uncompetitive with simple addition of sodium dithionite based products.

One type of sequesterant used in the pulp bleaching industry is the polyphosphates, such as sodium tripolyphosphate (STPP) and tetrasodium pyrophosphate (TSPP). However, these would be incompatible with the commercial sodium borohydride/sodium hydroxide solutions used in dithionite generation, due to hydrolysis over the product's storage period. Furthermore, polyphosphates are undesirable from the standpoint of adding phosphate to the environment.

Another type of chelant, aminomethylene phosphates, are relatively expensive, and, like the polyphosphates, eventually contribute phosphate to the environment.

Organic carboxylates, such as low molecular polyacrylates, are another type of suitable chelant; but again, the cost penalty of these high-priced chelants is too high for use in dithionite generation systems.

A well known type of chelants is the aminomethylene carboxylates (AMC). The lowest molecular weight member of this class is nitrillotriacetic acid (NTA) and its salts. This compound was ruled out for consideration because of a public perception, based upon early reports (probably erroneous), that this chemical is a carcinogen.

The most well-known and least expensive of the aminomethylene carboxylates is ethylenediamine tetraacetic acid (EDTA) and its salts, and this chelating agent was initially viewed as the choice chelating agent for addition to sodium borohydride sodium hydroxide solutions. However, production of a practical sodium borohydride sodium hydroxide $EDTA.Na_4$ solution proved to be out of reach and initially led to the conclusion that AMC's, in general, could not be practically added to sodium borohydride sodium hydroxide solutions.

The present commercial solution used for dithionite generating units contains 12% sodium borohydride by weight/40% sodium hydroxide by weight. Morton International, Inc. sells such a solution under the registered trademark BOROL. Solutions of these concentrations are achieved by common production methods and are used, without further processing, in dithionite generation system. Solutions more concentrated in sodium borohydride could be used, but preparation of a more concentrated solution would require the addition of dry sodium borohydride to the solution that is produced by common sodium borohydride production methods. Addition of dry sodium borohydride would inherently exact too high a cost penalty for dithionite generation system.

It would be convenient to simply dissolved a dry AMC, such as dry EDTA or EDTA.$Na_4$, in 12% sodium borohydride/40% sodium hydroxide solutions. Unfortunately, such 12/40 solutions approach the limits of solubility of their components, and cannot accept additional species, such as chelating agents. In fact, a 12/40 solution is sufficiently saturated that care must be taken in its shipping and storage that its temperature does not drop substantially below 8° C., lest precipitation occurs. Because EDTA.$Na_4$ cannot be practically added in dry form to 12/40 solutions, it was decided to blend a solution of EDTA tetrasodium salt (EDTA.$Na_4$) with the 12/40 solution. The most concentrated EDTA.$Na_4$ solution generally commercially available is 38% (wt) EDTA.$Na_4$ (Such a solution is typical of that which would be added to pulp prior to or concurrent with dithionite addition.) A final commercial product solution should contain as much chelant and sodium borohydride as possible in the ratio of at least 1 part chelating agent to each 3 parts sodium borohydride and ≧30% sodium hydroxide; and be preparable from the commercial chelant solution and the commercial (lower cost) 12% sodium borohydride/40% sodium hydroxide soltuion. Such a solution would provide ample long-term product stability, provided that it contained ≧30% (NaOH); and it would generally provide ample chelant to solve the metal precipitation problem in the dithionite generation unit and also ample chelant for brightness enhancement in the pulp bleaching operation. Again, the advantages of such a single solution would be to obviate the need for separate chelant addition. This solution would both provide chelant for the dithionite generation unit, thereby eliminating the problem of scale or specking due to the presence of calcium, magnesium and iron; as well as providing chelant to improve the subsequent bleaching process.

Unfortunately, it was found that 38% EDTA.$Na_4$ solution cannot be added directly to a 12/40 solution; precipitation results. Even using a solution of EDTA.$Na_4$ at a 0.33 weight ratio of EDTA.$Na_4$ to sodium borohydride, and dilution water; a mixed solution containing approximately 30% sodium hydroxide cannot be obtained by direct blending. A stable solution containing only 0.9% EDTA.$Na_4$ (and 9% $NaBH_4$ and 30% NaOH) can be prepared. This is not a suitable commerical solution. The chelating agent in this solution is sufficient for chelation in the dithionite generation unit, but generally provides insufficient additional chelant for brightness enhancement in the bleaching process. A pulp processor would still likely have to add a separate stream of additional chelant to the bleaching process. Importantly, although chelant is now present for the dithionite generation unit, the lower borohydride content results in costs with respect to shipping and storing addition water, which are too high to justify the slight advantage of having a mixed solution for the only dithionite generation unit.

SUMMARY OF THE INVENTION

In accordnace with the present invention, there is provided a clear, stable solution containing between about 1 and about 3.5 wt percent, preferably between about 2.5 and about 3.5 wt percent, diethylenetriaminepentaacetic acid pentasodium salt (DTPA.$Na_5$), between about 8 and about 12 wt percent sodium borohydride and about 30 wt percent or greater sodium hydroxide. Such solutions are physically stable at 15° C. or above, indefinitely.

DETAILED DESCRIPTION OF CERTAIN PREFERRED EMBODIMENTS

The invention provides a solution, useful in a dithionite generation unit, that provides sodium borohydride, sodium hydroxide and sufficient chelant, not only for the requirements of the dithionite generation unit, but, in many cases, sufficient additional chelant to meet the chelating requirements of the pulp bleaching process.

In view of the fact that it proved impossible to provide anywhere near enough EDTA.$Na_4$ for both the dithionite generation unit and pulp bleaching into a solution containing sufficient levels of sodium borohydride and sodium hydroxide for commercial practicality, it is surprising that another AMC, i.e., diethylenetriaminepentaacetic acid or its pentasodium salt (DTPA or DTPA.$Na_5$), can be added to high concentrations of sodium borohydride/sodium hydroxide at levels adequate for both the dithionite generation unit and the pulp bleaching process. DTPA is the next higher homolog AMC in the series up from EDTA. DTPA.$Na_5$ has similar solubility in water to EDTA.$Na_4$ and has a similar charge/weight ratio. Thus, there would be nothing to indicate that it would be much more compatible with a sodium borohydride/sodium hydroxide solution than EDTA.$Na_4$. However, surprisingly and unexpectedly, a stable solution can be formed containing sufficiently high concentrations of sodium borohydride and sodium hydroxide plus DTPA.$Na_5$ at a level sufficient for the dithionite generation unit and also for enhancing brightness in the pulp bleaching process.

Solutions in accordance with the present invention contain between about 1 and about 3 wt percent, preferably between about 2.5 and about 3.5 wt percent, diethylenetriaminepentaacetic acid pentasodium salt (DTPA.$Na_5$), between about 8 and about 12 wt percent sodium borohydride and about 30 wt percent or greater sodium hydroxide. Such solutions are physically stable at 15° C. or above, indefinitely. Such solutions are prepared at a weight ratio of DTPA.$Na_5$ to sodium borohydride of between about 0.08 and about 0.43 and a weight ratio of sodium hydroxide to sodium borohydride of between about 2.5 and about 3.75.

Solutions in accordance with the present invention are most conveniently prepared by mixing a solution of sodium borohydride/sodium hydroxide, e.g., 12/40 solution, with a prepared solution of DTPA.$Na_5$ at an appropriate volume ratio. DTPA.$Na_5$ is sold commercially, e.g., at a 40.2% DTPA.$Na_5$ solution, and is diluted down prior to its addition to the 12/40 solution. Although, it would be desirable in some instances to add a 40.2% DTPA.$Na_5$ solution to 12/40 solution, straight, to provide even higher levels of DTPA.$Na_5$, DTPA.$Na_5$ is not sufficiently compatible. What is suprising is that DTPA.$Na_5$ is about 2–4 times more compatible with sodium borohydride/sodium hydroxide solutions than is EDTA.$Na_4$, enabling DTPA.$Na_5$ to be added at sufficient levels to chelate free metal ions in both the dithionite generation unit and in the pulp bleaching process. As there is some heat of mixing DTPA.$Na_5$ solutions with concentrated sodium borohydride/sodium hydroxide solutions, mixing of the solutions is generally done in a manner that removes excess heat. Commercially available solutions of DTPA.$Na_5$ typically contain sodium hydroxide; accordingly, the ratio of sodium hydroxide to sodium borohydride will typically be higher in the mixed solution than in the initial sodium borohydride/sodium hydroxide solution. However, as additional sodium hydroxide is conventionally added to the dithionite generation unit, the additional sodium hydroxide is advantageous.

Amounts of DTPA are herein calculated relative to the pentasodium salt, as this will be the effective form that it is in in the final solution (due to the high levels of sodium hydroxide present), regardless of the form of DTPA initially added.

The use of DTPA.$Na_5$ as a chelant in pulp bleaching is not unknown. In fact, in relatively expensive oxidative bleaching processes where high brightness is desired, it is often the choice over EDTA.$Na_4$ because of greater stability in the presence of the oxidative bleaching chemicals. On the other hand, for reductive bleaching processes, EDTA.$Na_4$ is generally the choice over DTPA.$Na_5$ because of its lower cost. Probably the only situations where DTPA.$Na_5$ is currently used in reductive bleaching is in a combined oxidative/reductive bleaching process where the pulp processor wishes to use a single chelant throughout. Despite the use of slightly higher cost DTPA.$Na_5$ and the dilution of the sodium borohydride/sodium hydroxide solution by addition of the DTPA.$Na_5$ solution, the advantages of being able to use a single solution that provides both chelant and sodium borohydride/sodium hydroxide plus the advantage of providing chelant in the dithionite generation unit are considered, on the whole, to make solutions in accordance with the present invention commercially attractive.

The invention will now be described in greater detail with respect to the following examples.

EXAMPLE 1

Preparation of Blends

A suitable borohydride chelant solution which contained 3.6% DTPA.$Na_5$ (based on analysis)/8.9% $NaBH_4$ (based on analysis)/29.9% NaOH (based on analysis) was prepared in a $CO_2$-free atmosphere by first mixing 0.91 kg of distilled water and 0.42 kg of 40.2% solution of the pentasodium salt of diethylenetriaminepentaacetic acid (DTPA.$Na_5$).

This solution was cooled to 5°–10° C. after which 3.87 Kg of a 11.85% $NaBH_4$/39.64% NaOH solution was added at such a rate to keep the solution temperature below 35° C. External cooling (ice bath) was used to remove the heats of dissolution/mixing.

EXAMPLE 2

Yield of Dithionite from Borohydride/Chelant Solution Compared to Yield of Dithionite from Borol. Solution (12% $NaBH_4$/40% NaOH)

Into a round bottomed laboratory reaction flask, 869.5 g of distilled water was added and subsequently cooled to 10°–15° C. (ice bath) and sparged with nitrogen. External cooling and sparging are maintained throughout the reaction. While vigorously agitating via an overhead stirrer was maintained, 43.7 g $Na_2S_2O_5$ powder (47.85 g $NaHSO_3$) was added to the water. 15.57 g of a blend solution containing 3.5% DTPA.$Na_5$/9.8% $NaBH_4$/37.4% NaOH (molar ratio of 11.5 $NaHSO_3$/$NaBH_4$) was rapidly added to the bisulfite solution. Agitation was continued for 15 to 30 seconds and then stopped. The final solution had a pH of 6.8–7.2 and a temperature of <15°–20° C. Sodium dithionite analysis of the solution showed it to contain 2.4% $Na_2S_2O_4$ (TAPPI Standard Method T-622). The yield of sodium dithionite based on sodium borohydride was calculated to be 83.9% (Av. of 3 runs). Assuming no loss of chelant, this solution also contained a 0.058% DTPA.$Na_5$.

By comparison, analogous runs were done using BOROL solution (12% $NaBH_4$/40% NaOH) and bisulfite solution (11.5 mol $HSO_3^-$/$BH_4^-$) and the yield of sodium dithionite based on sodium borohydride was determined to be: 84.8±2%.

EXAMPLE 3

Brightness Response Studies the Dithionite Solutions Prepared in Example 2 Were Used in Brightness Response on Groundwood Pulp (GWD) and Thermomechanical Pulp (TMP)

The results are shown below:

| DITHIONITE SOURCE/MODE | % $Na_2S_2O_4$[a] | % DTPA.$Na_5$[a] | FINAL BRIGHTNESS (% ISO) GWD | TMP |
|---|---|---|---|---|
| Combined solution from blend | 1.0 | 0.021 | 68.9 | 67.4 |
| Combined solution from Borol and chelant solution | 1.0 | 0.025 | 69.1 | 67.2 |
| Sequential addition of diluted chelant solution and dithionite solution from Borol | 1.0 | 0.025 | 68.6 | 67.4 |

[a]Based on o.d. pulp

While the invention has been described in terms of certain preferred embodiments, modifications obvious to one with ordinary skill in the art may be made without departing from the scope of the present invention.

Various features of the invention are set forth in the following claims.

What is claimed is:

1. An aqueous solution consisting essentially of between about 1 and about 3.5 weight percent diethylenetriamine pentaacetic acid pentasodium salt, between about 8 and about 12 weight percent sodium borohydride and about 30% or more weight percent sodium hydroxide.

2. A solution according to claim 1 containing at least about 2.5 weight percent diethylenetriamine pentaacetic acid pentasodium salt.

* * * * *